US006206210B1

(12) United States Patent
Reed

(10) Patent No.: US 6,206,210 B1
(45) Date of Patent: Mar. 27, 2001

(54) DISPLAY/STORAGE RACK FOR HANGINGS

(75) Inventor: Robert Raymond Reed, Greenville, SC (US)

(73) Assignee: Patent Consultants & Services, Inc., Greer, SC (US)

( * ) Notice: Subject to any disclaimer, the term of this patent is extended or adjusted under 35 U.S.C. 154(b) by 0 days.

(21) Appl. No.: 09/239,869

(22) Filed: Jan. 29, 1999

(51) Int. Cl.[7] ..... A47F 5/08
(52) U.S. Cl. ..... 211/96; 211/168
(58) Field of Search ..... 211/96, 168, 98, 211/99, 100

(56) References Cited

U.S. PATENT DOCUMENTS

| | | | | |
|---|---|---|---|---|
| 113,129 | * | 3/1871 | Andrus et al. | 211/99 |
| 181,442 | * | 8/1876 | Howell | 211/99 |
| 292,199 | * | 1/1884 | Bellinger | 211/168 |
| 318,147 | * | 5/1885 | Stevens | 211/96 |
| 368,036 | * | 8/1887 | Westfall | 211/96 |
| 418,497 | * | 12/1889 | Brucker | 211/99 |
| 586,977 | * | 7/1897 | Sibley | 211/96 |
| 691,368 | * | 1/1902 | East | 211/99 |
| 1,162,298 | * | 11/1915 | Metcalf | 211/96 |
| 1,436,449 | * | 11/1922 | Kirsch | 211/96 |
| 1,545,122 | * | 7/1925 | Brown | 211/99 |
| 1,563,057 | * | 11/1925 | Williams | 211/96 |
| 1,973,974 | * | 9/1934 | Campbell | 211/96 |
| 2,046,824 | * | 7/1936 | Kenney | 211/96 X |
| 2,429,037 | * | 10/1947 | Tarnay | 211/96 |
| 3,635,352 | * | 1/1972 | Brooks et al. | 211/168 X |
| 4,856,661 | * | 8/1989 | Guillen et al. | 211/100 |
| 5,236,095 | * | 8/1993 | Krizka | 211/96 |
| 5,535,896 | * | 7/1996 | Morgan, Sr. | 211/96 |

* cited by examiner

*Primary Examiner*—Daniel P. Stodola
*Assistant Examiner*—Khoa Tran
(74) *Attorney, Agent, or Firm*—Robert R. Reed

(57) ABSTRACT

A display/storage rack system for hangings. The hangings are each carried by an elongated hanging member. Commonly the hanging is draped over the elongated hanging member. The rack system is affixed to a vertical support surface and supports a first end of the elongated hanging member as a cantilever; with an optional fixed bracket device supporting a second end of the elongated hanging member for displaying the hangings. A plurality of pivotal support devices of the rack system include offset arms for supporting and displaying the hangings in the rack in spaced apart vertical planes so that they do not contact one another and their top edges are at a different elevation. Hangings are displayed so that a top portion of each hanging is visible from the front of the storage rack. A pivot support rod of the rack system supports the pivotal support devices so that it can be rotated about a pivotal axis of the rack system. The hangings at the front of the rack can be rotated out of the way when hangings at the back of the rack nearer to the support surface are to be retrieved. In a further embodiment, a portable unit can transport the support surface with the attached rack system from place to place for displaying the hangings.

8 Claims, 6 Drawing Sheets

5
30
32
18
4
20A
12
P
22a
23C
20B
22C
24C
22b
30
16
P
26C
27C
18
20C 10
14
5
20D
20E

DISPLAY/STORAGE RACK FOR HANGINGS

BACKGROUND OF THE INVENTION

This invention is directed to a system for supporting and sustaining hanging objects for visual display and/or storage, and in particular an apparatus where each object can be easily accessed by an individual.

Many articles require temporary storage or must be displayed in a hanging position before or after they are used. The needs for an efficient display and\or storage rack means for these articles are similar in that the article should be disposed in a hanging position for efficiency in the space used for such display and/or storage. Numerous racks and rack assemblies have been used to achieve a hanging disposition for various articles. Architectural drawings are hung vertically by a variety of means when they are not in use. Paintings are also stored in much the same way as drawings are stored. Rugs and other tapestry are disposed in a hanging position when displayed in a retail store. Blankets, clothing and table cloths, as well as altar coverings in a church, are frequently stored in a generally vertical hanging position These and similar articles that are generally hung collectively in a vertical position adjacent to one another are collectively referred to in this invention as hangings. A hanging member is usually provided that allows each article to be suspended vertically from the rack system or rack assembly.

A number of problems exist with the present racks available to a user. One problem is in displaying the hangings so that an observer can see at least a portion of each hanging in a group of hangings. This is important when a number of hangings are being displayed to a customer in an effort to sell the one most desirable to the customer, such as displaying tapestry or rugs in a retail store. This is also important when storing a drawing when a title block is being obstructed by adjacent drawings. A second problem exists when a hanging is to be retrieved from a rack when it is not the one directly accessible for removal. This is important when the customer desires a hanging which is not the one at the front of the rack and those in front must be removed to access the desired one. This situation exists when an altar hanging for a particular religious event (i.e. Christmas and Easter) is to be retrieved from a storage rack and it is not the one in front. Storage racks in the art for this purpose are commonly fixed bracket devices that require complete removal of those hangings in front of the desired one. In addition, large hangings require more than one person to remove them.

Accordingly, an object of the present invention is to provide a display and/or storage rack for hangings where there is a vertical offset from one hanging to the next so that at least a portion of all hangings can be viewed at the same time.

Another object of the present invention is provide a display and/or storage rack assembly which provides easy access to an individual hanging in the rack without removal of the other hangings.

Still another object of the present invention is to provide access to an individual hanging in a rack of hangings by a single individual.

A further object of the present invention is to provide a display and/or storage rack assembly that can be mounted on a stationary object such as a wall, as well as a portable object or cart.

SUMMARY OF THE INVENTION

The above objectives are accomplished according to the present invention by providing a display/storage rack system for hangings having a pivotal bracket assembly supporting a first end of an elongated hanging member and a fixed bracket device supporting a second end of the elongated hanging member. The elongated hanging members support the hangings by an appropriate means depending on the type of hanging being displayed and/or stored. Commonly the hanging is draped over the elongated hanging member. Hangings are displayed in the rack in staggered horizontal and vertical stored positions so that a portion of each hanging is visible from the front of the rack and each hanging is offset vertically from the other hangings. In addition, the pivotal bracket assembly is made to support the elongated hanging member from the first end as a cantilever so that it can be rotated about the pivotal axis of the pivotal bracket assembly. In this manner the hangings at the front of the rack can be rotated out of the way when hangings at the back of the rack are to be retrieved. This allows the rack to be used as a display rack when the hangings are in a stored position. Hangings are referred to as being in a stored position when the second end is engaged with the fixed bracket device. However, the pivotal bracket assembly can also function as a complete rack system without the fixed bracket device. Details of the best mode to practice the invention are further disclosed in the following summary.

In one embodiment of the best mode a rack system supports a number of hangings each carried by an elongated hanging member so that each hanging is displayed and easily accessible. The rack system comprises a primary support member affixed to a supporting surface associated with displaying the hangings. A pivot support rod, having a pivotal axis, is carried by the primary support so that the pivotal axis extends vertically. The rack system further comprises a plurality of pivotal support devices arranged in series vertically along the pivot support rod so that the hangings have a vertical offset from one another. The support assemblies can be rotated in a generally horizontal plane about the pivotal axis. The pivotal support devices each have a horizontal offset arm, wherein lengths of the horizontal offset arms are different from one another so that the hangings are each hung in a different vertical plane. The pivotal support devices each have a support arm to receive a first end of the respective elongated hanging member of a respective hanging and hold the respective hanging in a predetermined vertical and horizontal position relative to the other hangings. As a result, the hangings are individually accessible by rotating selected support devices.

The rack system may further including a fixed bracket device attached to the supporting surface for supporting a second end of the elongated hanging members of specified hangings when the specified hangings are disposed in a displayed and stored position.

Another embodiment of the invention includes a rack assembly for temporary storage of hangings. The rack assembly comprises elongated hanging members for supporting the hangings in a generally vertical position. A pivotal bracket assembly is affixed to a supporting surface and includes a pivot support rod for supporting a plurality of pivotal support devices to receive and hold first ends of the elongated hanging members. A fixed bracket device is for supporting second ends of the elongated hanging members. Therefore, the hangings are retained so that a horizontal and a vertical offset exists between respective hangings. The rack assembly further comprises means for individually rotating at least one pivotal support device about the pivot support rod, whereby any one of the elongated hanging members and a respective hanging is removable from both said pivotal bracket assembly and said fixed bracket device while the others remain supported by at least said pivotal bracket assembly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
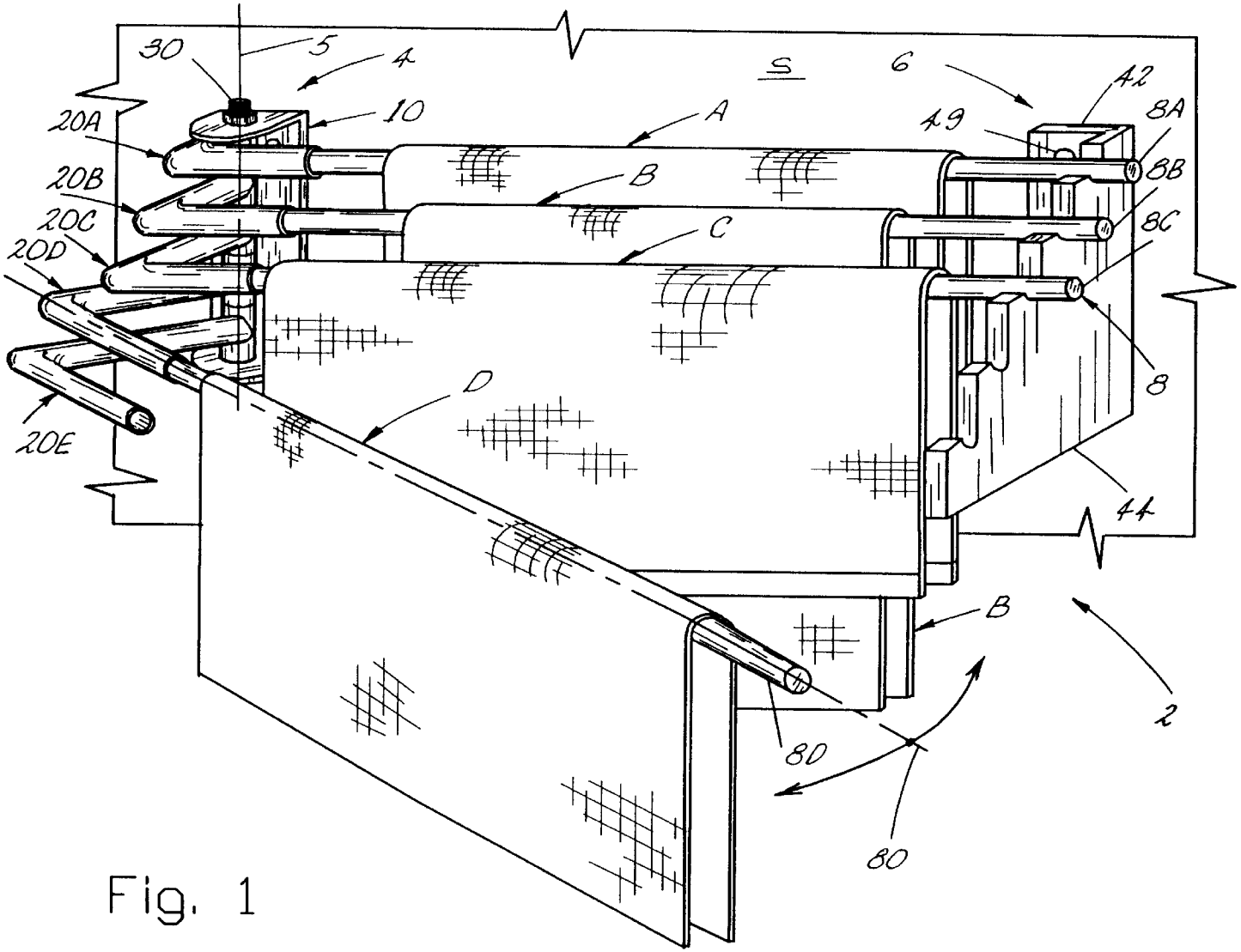
FIG. 1 is a perspective view of the display and/or storage rack of the present invention having a capacity for five hangings in this embodiment of the invention.

Referring now in more detail to the drawings, the invention will now be described in more detail. A storage and display rack is provided that allows hangings to be displayed and/or stored and further to be individually viewed and/or accessed. Each hanging can be accessed by a single individual by simply rotating the hangings in the front of the rack out of the way of the hanging desired to be retrieved, as illustrated in FIG. 1. The rack of FIG. 1 illustrates the capacity to display and/or store five hangings. The same type of rack can be made for more or less the number of hangings. Further details of the rack structure and how it functions is included in the following description.

Referring in detail to FIG. 1, it is noted that individual hangings A–D are being displayed and/or stored by the display and storage rack 2. Associated with each hanging is some type of elongated hanging member 8 that holds and supports the hanging. Elongated hanging members 8A–8D can be individual members separate from a hanging or may be made as an integral part of the hanging. The display and storage rack 2 can be made to support a combination of hangings to include individual elongated hanging members and hanging members made as an integral part of the hangings, as desired by the user. As previously discussed, hangings include tapestry, rugs, blankets, church altar cloths, clothing, paintings, drawings and the like, each having their individual elongated hanging member 8. A pivotal bracket assembly 4 and a fixed bracket device 6 can be made to accommodate various hangings within the scope of this invention.

Hangings A–C are shown in FIG. 1 to be supported in a stored position by pivotal bracket assembly 4 at one end and fixed bracket device 6 at the other end. Hanging member 8D of hanging D has been removed from a support leg 44 of the fixed bracket device. Hanging D is being supported as a cantilever along hanging member axis 80 from pivotal bracket assembly 4 only. The pivotal bracket assembly includes a primary support member 10 which supports a pivot support rod 30. A plurality of pivot support devices 20A–20E are generally free to rotate about a pivotal axis 5 of the pivot support rod. Each pivotal support device receives and supports one end of a respective elongated hanging member. Pivotal support device 20D is rotated about pivot axis 5 so that hanging D can be rotated as shown by the curved arrows in FIG. 1. Rotating hanging D out of the way allows free access to hanging C. Hanging E is not shown; having been previously removed from the rack.

The display and storage rack is mounted to a supporting surface S to provide clearance for the hangings to hang as they should. The support surface can be part of a wall area or a separate support frame built especially for the display and/or storage function. The frame can be supported on a base or cart having rollers for movement of the rack from place to place. The base must be of a proper size, shape and weight to allow hangings in the front to be rotated out of the way when accessing a hanging in the rear stored closer to the supporting surface and not directly accessible.

Figures 2, 2A:
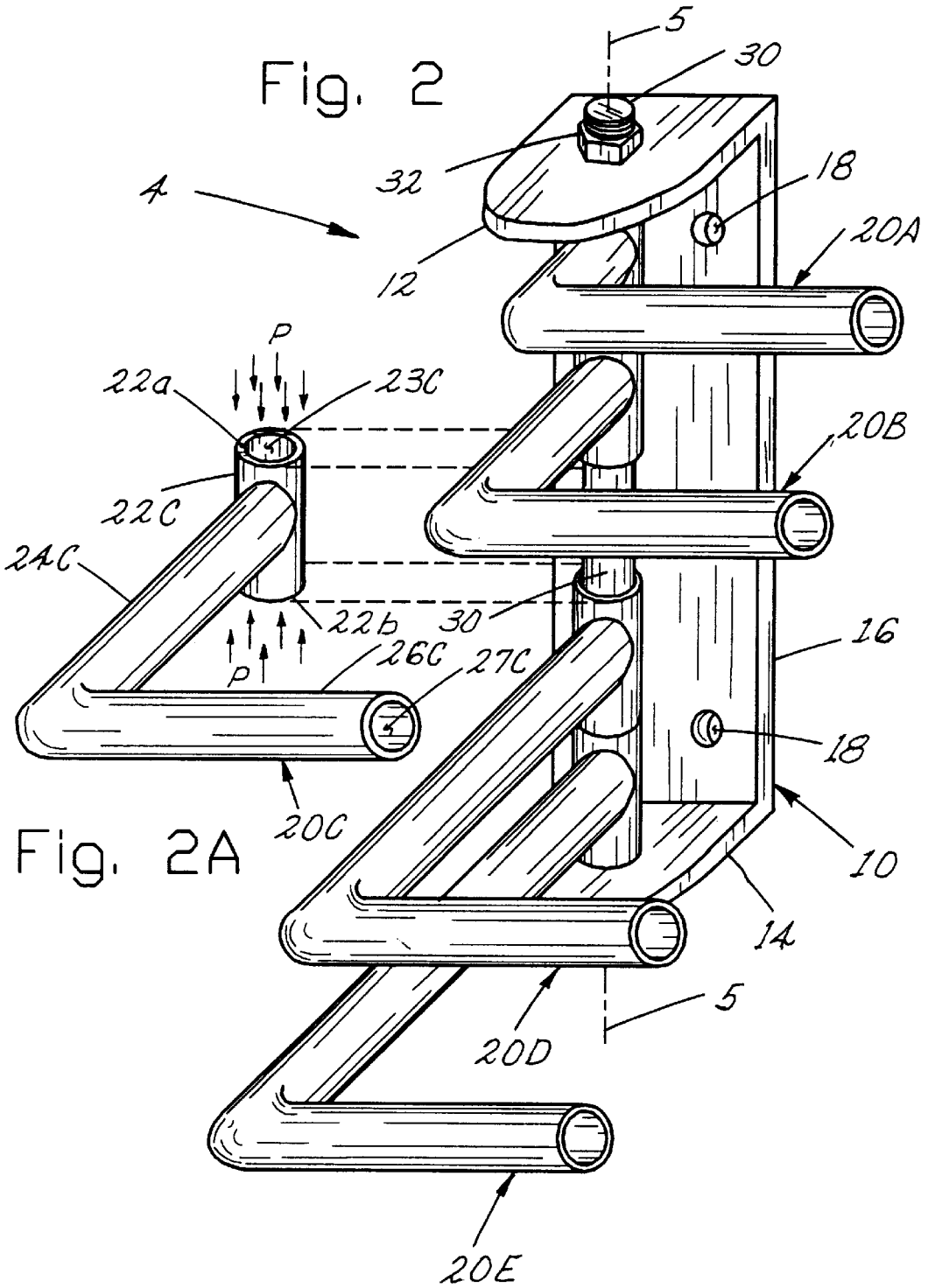
FIG. 2 is a perspective view of a pivotal bracket assembly of the invention showing one pivotal support device removed from the assembly to illustrate how each device relates to the assembly.

Details of the preferred bracket assembly of this invention are illustrated in FIG. 2. Primary support member 10 includes a support base 16 having a top flange 12 and a bottom flange 14 affixed thereto near the top and bottom of the support base respectfully.

Support base 16 has a plurality of base attachment bores 18 for attaching the support base to a supporting surface. Top and bottom flanges 12 and 14 carry a pivot support rod 30 held in place by a pivot adjustment device 32. The adjustment device can be adjusted to provide tension in the support rod and deflect the top and bottom flanges to be biased toward one another. This adjustment helps hold pivot support devices as further disclosed.

A plurality of pivot support devices 20A–20E are held in position by support rod 30. To illustrate this support, pivotal support device 20C has been displaced from its normal position to an offset position; illustrated in FIG. 2A. Each pivotal support device has a vertical pivot member 22C, a horizontal offset arm 24C and a hanging support arm 26C. Referring to pivotal support device 20C in FIG. 2A, vertical pivot member 22C has a vertical bore 23C to allow the passage of pivot support rod 30 through the vertical pivot member. Pivot adjustment device 32 (FIG. 2) can be adjusted to increase or decrease the pressure P on the top and bottom interfaces 22*a* and 22*b* of vertical pivot member 22C (FIG. 2A). Interfaces are those top and bottom surfaces in contact with adjacent pivot support devices 20B and 20D respectively.

Horizontal offset arm 24C of pivotal support device 20C provides an offset distance from pivotal axis 5 which is different from the offset distances for other pivot support devices 20A, 20B, 20D and 20E. The horizontal offset arm carries a hanging support arm 26C at the radial outer end of the horizontaloffset arm from the pivotal axis. The horizontal offset arm must have a torsional rigidity to resist the tendency of the hanging support arm to rotate in a vertical plane when supporting a hanging. The absence of rotation is achieved without the assistance of the fixed bracket device (FIG. 1).

Hanging support arm 26C of pivotal support device 20C provides a means for receiving and supporting a elongated hanging member of a hanging. For example, if the hanging member is in the shape of a rod, a cylindrical support arm bore 27C is provided. The support arm bore may be made of any size and shape to be consistent with the size and shape of the elongated hanging member. The other pivotal support devices 20A, 20B, 20D and 20E are preferably constructed to be similar to pivotal support device 20C, except for the lengths of respective horizontal offset arms. These lengths are made to be different from one another so that the angings will clear one another as they hang.

Figure 3:
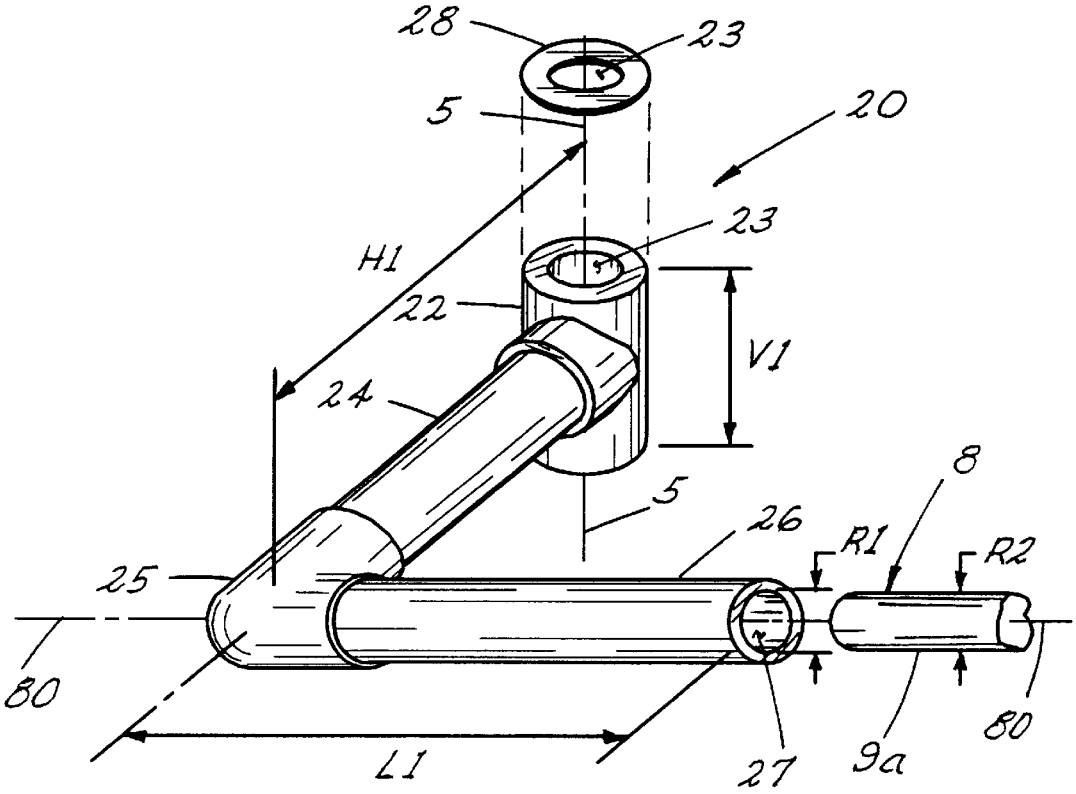
FIG. 3 is a detailed perspective view of another embodiment of the piotal support device of this invention and further showing the geometry of the device.

Additional embodiments of a pivotal support device 20 are illustrated in FIG. 3. A vertical pivot member 22 having a vertical bore 23 is made to have a vertical height V1 to provide a vertical distance between adjacent hangings as illustrated in FIG. 1. Vertical height V1 allows for adequate viewing of each one of the hangings without being obstructed by the adjacent hangings. The vertical distance can be the same for hangings of the same type or different for hangings of different type. The ability of the pivotal support device to be rotated about pivotal axis 5 can be improved with the addition of a friction element 28 between adjacent pivotal support devices. The friction element can be a washer coated with a friction reducing coating, a flat roller bearing or the like. The friction element is designed to provide the proper control of the pivotal support device when rotated about the pivotal axis. Control includes the ability of the user to easily pivot the support device as well as the ability of the pivotal support device to remain in a rotated position without assistance from the user. This action leaves the user free to remove the hanging being retrieved.

As previously discussed, a horizontal offset arm 24 is used to support a hanging support arm 26 at a radial outer end of the offset arm. The radial distance is the offset length H1 illustrated in FIG. 3. An arm connector element 25 can be used to connect the hanging support arm to the radial outer end of the horizontal offset arm. Horizontal support arm 24 and the connector element 25 must have a torsional rigidity sufficient to generally resist the tendency of the hanging support arm to rotate in a vertical plane. The hanging support arm has a support arm bore 27 for receiving and holding a first end 9*a* of an elongated hanging member 8. With a cylindrical bore, as illustrated in FIG. 3, the diameter R1 of the support arm bore must be larger than the outer diameter R2 of first end 9*a* of the elongated hanging member. This provides easy placement of the end of the hanging member into the hanging support arm, along a hanging member axis 80, for display or storage. Other configurations of the support arm bore and the first end of the hanging member can be used within the scope of this invention. A support arm length L1 is provided to maintain the elongated hanging member engaged with and supported by the hanging support arm when first end 9*a* is placed in the support arm bore.

The pivotal support device can be made with standard plastic, copper or steel pipe fittings known in the industry. Vertical pivot member 22 can be a pipe tee, arm connector element 25 can be a pipe tee and arms 24 and 26 can be pipe nipples. The components can be connected together and the joints can receive additional adhesive material, solder of welds as required for rigidity of the pivotal support device. The type, size and strength of the components of the pivotal support device, as well as other components of the rack, depend to a large degree on the size and weight of the hangings. However, the rack of this invention applies to a wide variety of hangings by simply changing the size of the rack components.

Figure 4:
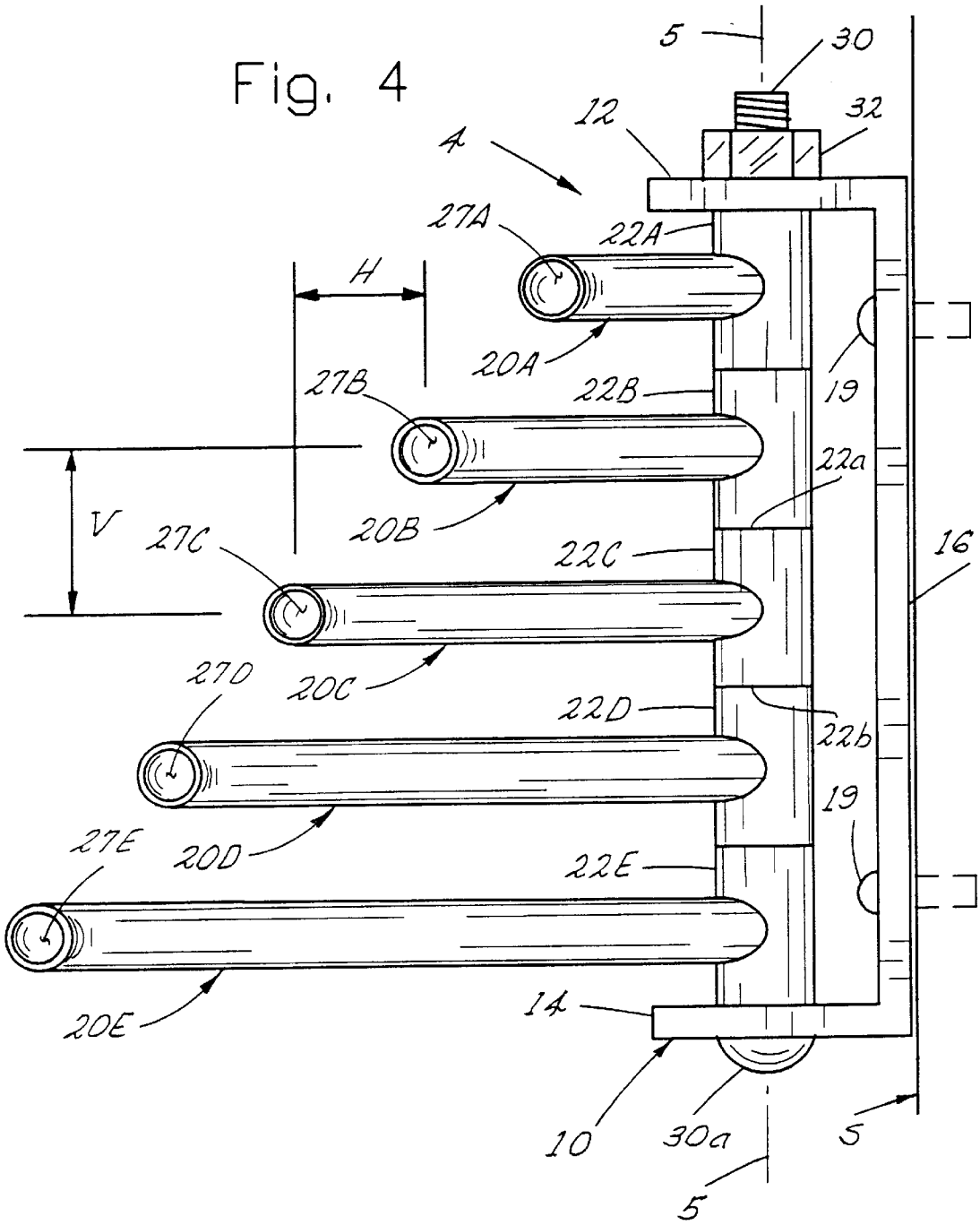
FIG. 4 is a side elevation view of the pivotal bracket assembly according to the preferred embodiment of the invention.

Additional details of pivotal bracket assembly 4 are illustrated in the side view of FIG. 4. Fasteners 19 hold the support base 16 of the primary support member 10 affixed to a supporting surface S. Any appropriate fastener means may be used including bolts, rivets or screws and the like depending on the size of the pivotal bracket assembly and the loads it must support. Other means can also be used to affix the support base to the supporting surface to include adhesives and welds. Top and bottom flanges 12 and 14 support pivot support rod 30 so that pivotal axis 5 is vertical. The pivot support rod is held in position by a head 30*a* at the bottom flange and pivot adjustment device 32 at the top flange. Pivotal support devices 20A–20E are held in series vertically between the top flange and the bottom flange. The pivot support rod extends through each vertical pivot member 22A–22E of the pivotal support devices so they are generally free to rotate about pivotal axis 5.

Each pivot support device is free to rotate horizontally through an angle, provided the friction between adjacent pivotal support devices and any flange is overcome. For example, a torsion moment due friction at both the top interface 22*a* and the bottom interface 22*b* of vertical pivot member 22C must be exceeded for pivotal support device 20C to rotate relative to the other pivotal support devices. The required torsional moment to rotate pivotal support device is controlled by the tension in pivot support rod 30. The amount of tension in pivot support rod is controlled by pivot adjustment device 32. Top and bottom flanges 12 and 14 must be somewhat flexible so they can be biased toward or away from each other when tension in the pivot support rod is adjusted. In this manner the forces at interfaces between vertical pivot members and between vertical pivot members and the flanges can be changed to change the torsional moment required to rotate the pivotal support devices. Adjustments are made using pivot adjustment device 32 so that pivotal support devices 20A–20E can be rotated by hand but remain in a rotated position when released. Therefore, one person can rotate a hanging out of the way when accessing another hanging and it will not return due to the force of gravity when released. This is illustrated in FIG. 1 where hanging D will remain in the position shown to allow hanging C to be retrieved from the rack without interference from hanging D.

The illustration of FIG. 4 shows pivotal support devices 20A–20E all aligned to receive first ends 9*a* of hanging members 8 in respective support arm bores 27A–27E. The friction at the interfaces previously disclosed for vertical pivot members 22A–22E will keep the pivotal support devices stable while the first ends are being placed in the support arm bores without additional guiding assistance. This is important when placing a hanging member in the rack. Hangings placed in pivotal bracket assembly 4 will have a horizontal offset distance H and a vertical offset distance V. These offset distances will permit visual observation of each hanging from a position perpendicular to and in front of supporting surface S and will allow the hangings to hang independent of one another in different generally vertical spaces. The supporting surface can be part of a portable cart or unit "PU" used to move the hangings from place to place.

Figure 5:
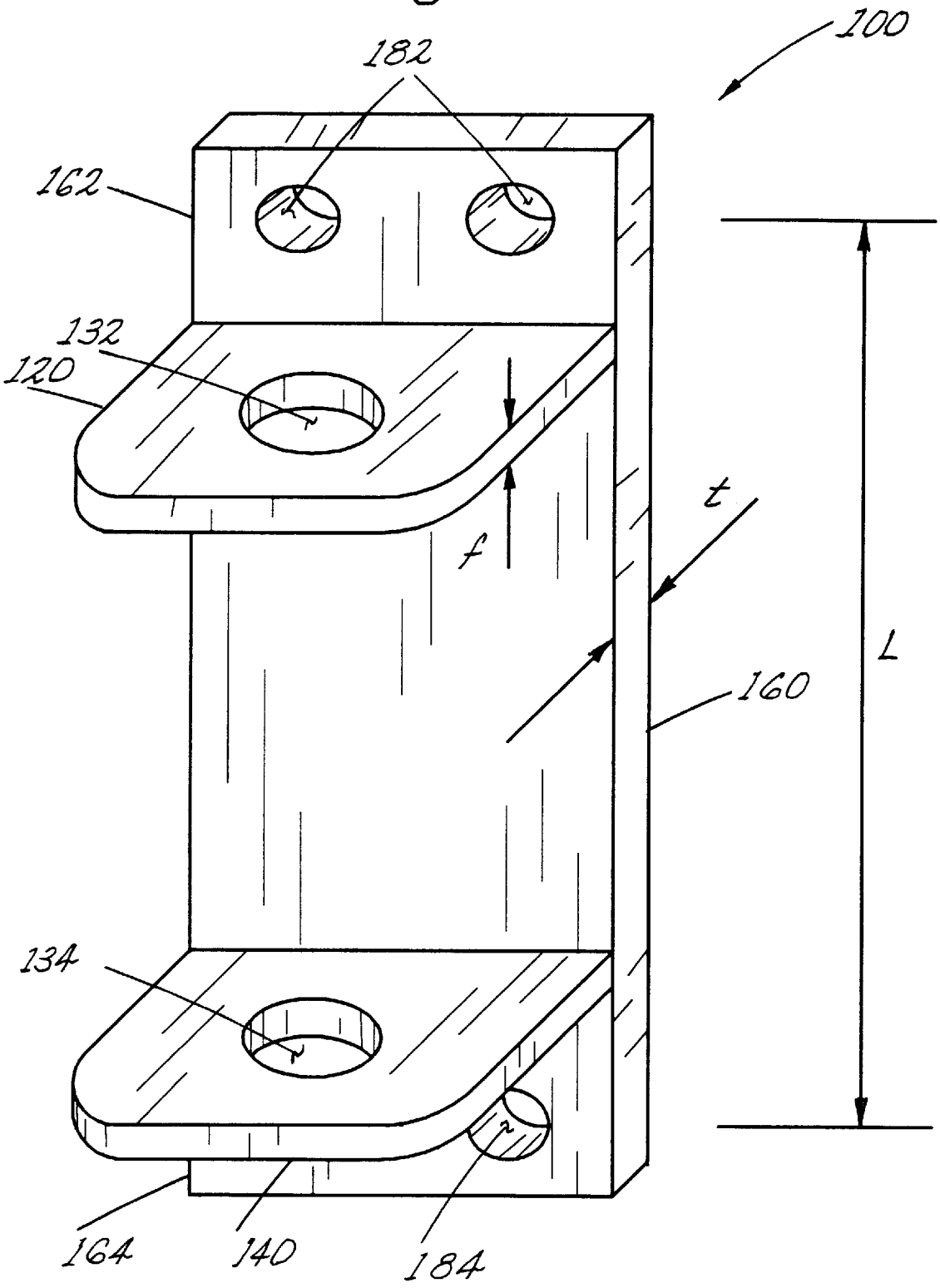
FIG. 5 is a perspective view of another embodiment of the primary support member of this invention.

The primary support member can be designed to provide for a larger or smaller number of pivotal support assemblies. The illustrations of FIGS. 1, 2 and 4 show a primary support member 10 to provide for five pivotal support members. The primary support member is further designed to support the loads of the hangings, especially when a number 1 of hangings are supported in a cantilever manner by the pivotal bracket assembly without the assistance of a fixed bracket device. Another embodiment of the primary support device is illustrated in FIG. 5. A primary support member 100 designed to better resist the loads of relatively large sized hangings is shown. A support base 160 is extended vertically to include a top base portion 162 and a bottom base portion 164. The thickness "t" of the support base is also adjusted to accommodate the greater loads. Two top bore holes 182 and bottom bore holes 184 provide a better opportunity to connect the support base to a supporting surface. The larger distance L between bore holes allows for a greater moment on the primary support member 100 to be resisted through fasteners (not shown).

The shape and thickness "f" of a top flange 120 and a bottom flange 140 is provided to resist the loads reacted at support rod bores 132 and 134. Top and bottom flanges are affixed to support base 160 or can be made as an integral part of the support base. In addition, the flanges can have other configurations; such as angular shaped with one leg attached to the vertical surface of the support base.

Figure 6:
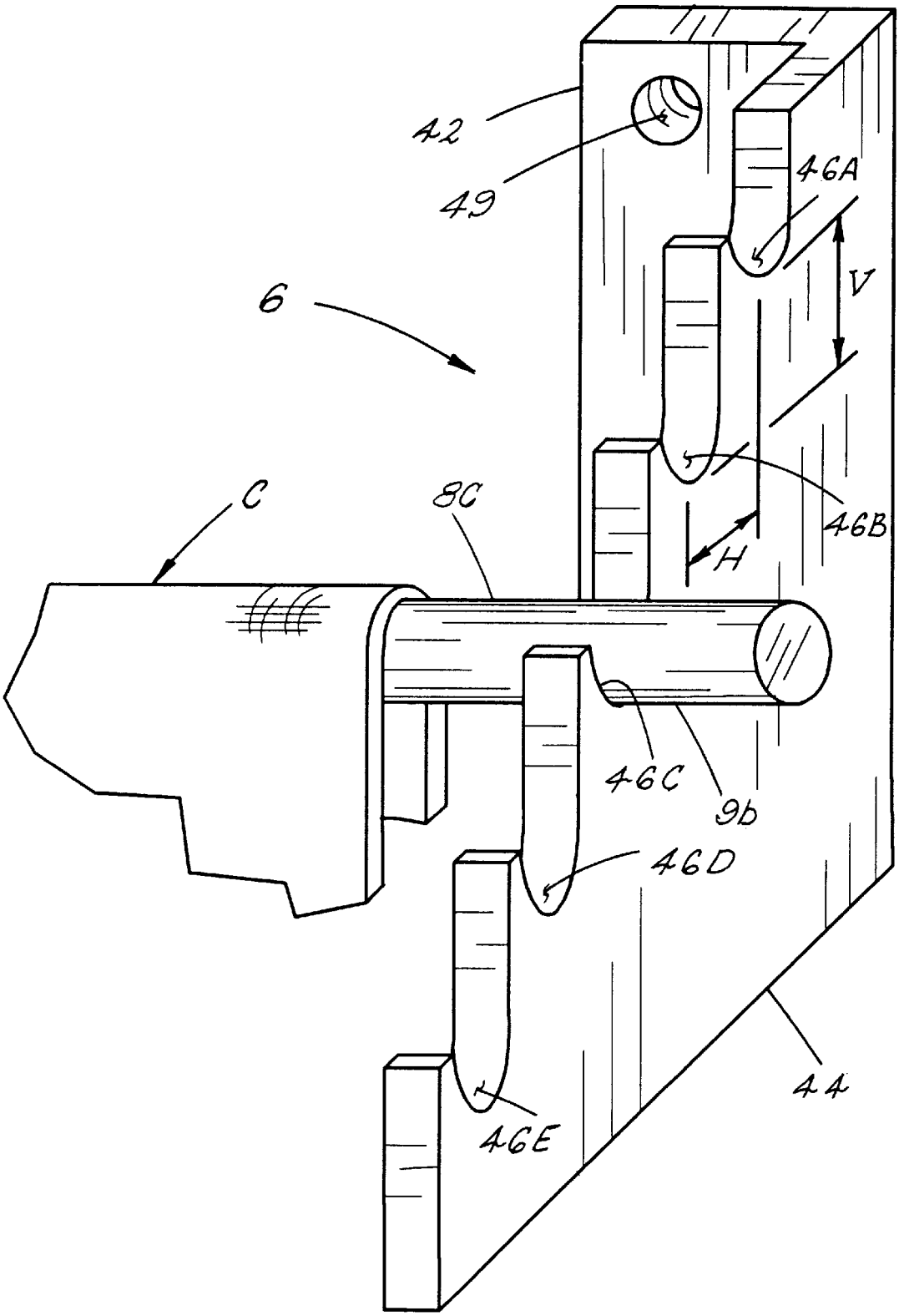
FIG. 6 is a perspective view of a fixed bracket device of the invention.

A typical fixed bracket device 6 is illustrated in FIG. 6. The fixed bracket device includes an attachment leg 42 with at least one attachment leg bore 49 to receive a fastener when attaching the fixed bracket device to the supporting surface. A support leg 44 of the fixed bracket device is configured to include hanging member cutouts 46A–46E that are made to conform with the number and location or hangings supported by pivotal bracket assembly 4 (see FIG. 1).

The number, size and spacing of hanging member cutouts is made to accommodate the configuration of the pivotal bracket assembly. Adjacent hanging member cutouts are vertically spaced apart a distance V and horizontally spaced apart a distance H. These distances are made to agree with those of the pivotal bracket assembly (FIG. 4). Each cutout receives a second end 9*b* of the elongated hanging member supporting a hanging. For example, cutout 46C receives second end 9*b* of hanging member 8C. Hanging member 8C is easily removed by hand from the fixed bracket device by simply lifting the second end of the hanging member vertically and rotating the hanging about the pivotal axis of the pivotal bracket assembly and away from the fixed bracket device.

Various materials may be used to build the display/storage rack of this invention; depending on the size and weight of the hangings to be displayed and/or stored. A prototype storage rack was made that included a primary support member of the pivotal bracket assembly made with a support base of wood. The wood support base was bolted to a wall. Top and bottom flanges were steel angles bolted to the wood support base. The pivotal support devices of the pivotal bracket assembly were first made with plastic pipe fittings and the pivot support rod was a threaded steel rod extending through the top and bottom flanges with a nut at both ends of the rod. Either the top or the bottom nut could be adjusted to change the friction at the interfaces of the pivot support devices. The rack stored six different altar cloths which were to be used one at a time to cover the altar of a church. A different altar cloth was to be used for different times of the year. The individual cloths were about six feet in length with a weight of about twenty pounds each. Different cloths were accessed at different times. The weight of these cloths made it necessary to convert the plastic pivotal support device so steel pivotal support devices made with steel pipe fittings. The steel pipe fittings were rigid enough to support the weight of the cloths when rotated and supported only by the pivotal bracket assembly. The use of other metalic, plastic and composite materials to construct the various components of the rack are within the scope of this invention.

A preferred embodiment of the invention has been described using specific terms, such description is for illustrative purposes only, and it is to be understood that changes and variations may be made without departing from the spirit or scope of the following claims.

What is claimed is:

1. A rack system for supporting a number of hangings each carried by an elongated hanging member so that each hanging is displayed and easily accessible, said rack system comprising:

a primary support member affixed to a vertically disposed support surface associated with displaying the hangings;

a pivot support rod having a pivotal axis and carried by said primary support member so that said pivotal axis extends vertically;

a plurality of pivotal support devices arranged in series vertically along said pivot support rod for supporting the elongated hanging members that carry the hangings, wherein said pivotal support devices are supported and separately rotatable in a generally horizontal plane about said pivotal axis;

said pivotal support devices each include a vertical pivot member having a vertical bore to receive said pivot support rod, wherein the pivot members contact each other end to end along said support rod;

said pivotal support devices each having a horizontal offset arm affixed at one end to said vertical pivot member, wherein said offset arms extend perpendicular to said pivotal axis with individual lengths of said horizontal offset arms increasing from top to bottom;

said pivotal support devices each having a horizontal support arm affixed at one end to the outer end of said offset arms and extending generally perpendicular to said offset arm, said support arms to receive at the other end a first end of the respective elongated hanging member for supporting a respective hanging, wherein the hangings are displayed in parallel spaced apart vertical planes one from another with their top edges at a different elevation and whereby the individual hangings are easily accessible by rotating selected pivotal support devices.

2. The rack system of claim 1 wherein the primary support member includes a support base attached to said supporting surface, a top flange and a bottom flange, said flanges are for receiving and holding said pivot support rod so that said pivotal axis is maintained in a vertical position.

3. The rack system of claim 2 wherein said pivot support rod includes a pivot adjustment device for adjusting tension in said pivot support rod.

4. The rack system of claim 3 wherein said vertical pivot member includes a top interface end and a bottom interface end to provide friction surfaces for controlling the rotational position of said each pivotal support device relative to other pivotal support devices when rotated and released.

5. The rack system of claim 4 wherein said pivot adjustment device is adjusted to bias said top and bottom flanges in one of either toward or away from one another to change the friction at said top and bottom interfaces of each vertical pivot member, wherein resistance to rotation of the pivotal support devices around said pivot support rod can be changed.

6. The rack system of claim 1 including a fixed bracket device, also attached to said supporting surface, for supporting a second end of said elongated hanging members when the hangings are disposed in a displayed and stored position.

7. The rack system of claim 1 wherein said hanging support arm includes a support arms bore that conforms to a shape and size of said first end of said respective elongated hanging member so that said hanging support arm receives the elongated hanging member aligned along a hanging member axis.

8. The rack system of claim 1 wherein said support surface is part of a vertical wall.

* * * * *